US006003695A

United States Patent [19]

Turner

[11] Patent Number: 6,003,695

[45] Date of Patent: Dec. 21, 1999

[54] GARMENT HANGING TOOL

[76] Inventor: Robyn D. Turner, 990 Bear Ridge Rd., Westcliffe, Colo. 81252

[21] Appl. No.: 09/231,095

[22] Filed: Jan. 14, 1999

[51] Int. Cl.[6] ..... A47F 5/08; D06F 53/00; A47H 1/02

[52] U.S. Cl. ..... 211/106; 211/119.12; 211/105.1

[58] Field of Search ..... 211/106, 119.12, 211/105.01, 106.01, 181.1, 183

[56] References Cited

U.S. PATENT DOCUMENTS

| | | | |
|---|---|---|---|
| 575,480 | 1/1897 | Josephs | 211/119.12 |
| 950,320 | 2/1910 | Fonda | 211/119.12 |
| 974,052 | 10/1910 | Greiner | 211/119.12 |
| 1,187,189 | 6/1916 | Sholl | 211/119.12 |
| 2,620,074 | 12/1952 | Morre, Jr. | 211/119.12 |
| 3,202,329 | 8/1965 | Schmidt | 211/119.12 |
| 3,235,095 | 2/1966 | Neill | 211/113 |
| 3,887,079 | 6/1975 | Crew | 211/119.12 |
| 3,993,205 | 11/1976 | Pilchard | 211/119.12 |
| 4,169,534 | 10/1979 | Donovan | 211/119.12 |
| 4,730,737 | 3/1988 | Robinson | 211/113 |
| 5,056,670 | 10/1991 | Fine | 211/85.3 |
| 5,147,078 | 9/1992 | Flieder | 211/119.12 |
| 5,642,817 | 7/1997 | O'Brien | 211/60.1 |
| 5,647,490 | 7/1997 | Hull et al. | 211/90.01 |

*Primary Examiner*—Daniel P. Stodola
*Assistant Examiner*—Jennifer E. Novosad
*Attorney, Agent, or Firm*—Jack C. Munro

[57] ABSTRACT

A garment hanging tool that has an elongated body forming a front section and a rear section. Separating the front section and the rear section is a rod hanger section with the rod hanger section being adapted to rest on a closet rod. The rear section terminates in an enlargement which is to abut against a wall of the building structure within which is mounted the closet rod. The front section has a hanger engagement with the hanger engagement to connect with at least one conventional garment hanger to position a garment mounted on the garment hanger spaced from the closet rod.

6 Claims, 2 Drawing Sheets

GARMENT HANGING TOOL

BACKGROUND OF THE INVENTION

1) Field of the Invention

The field of this invention relates to hangers and more particularly to a garment hanging tool that is to connect with a closet rod so as to support a garment, which is hung on a conventional hanger, in a spaced position from the closet rod.

2) Description of the Prior Art

Closet rods are commonly used in homes to support garments that are placed on a garment hanger in a stored position. Typically, garment hangers arrange the hung garments in a parallel orientation longitudinally along the length of the closet rod. When one desires to wear a particular garment, it is typical for the user to remove the garment and the garment hanger and disengage the garment from the garment hanger and then replace the now empty garment hanger back on the closet rod.

When an individual is getting dressed, it is generally deemed to be more convenient to remove the desired garment that is to be worn and its garment hanger and support the garment hanger in a position spaced from the closet rod. This provides easier access to the garment prior to placing of the garment on one's body. In the past, such hanging of the garment hanger and garment in a spaced position from the closet rod was accomplished by mounting of the hung garment on a door or on any kind of a protruding hook that could be conveniently located in close proximity to the closet rod.

Also, when garments have been cleaned and/or pressed, it is desired to hang the hanger supported garments on the closet rod. It is normally desirable to place the garments on their hangers in a position in close proximity to the closet rod but spaced therefrom and then the individual garments and hangers are placed at their desired location on the closet rod. Most individuals don't just place the hung garments on the closet rod at any position. Normally, the hung garments are distributed so that the shirts are located in one area, trousers in another area, shorts in another area and so forth. Also, within each area for each type of garment, such as with shirts, the shirts are commonly divided between the type of shirt and possibly the shirt color. The same is true for pants and shorts and so on. Therefore, when one has six or eight or ten garments that have been cleaned and/or pressed, it is desirable to support these garments in close proximity to the closet rod, remove them individually and place them in a desired location on the closet rod. Heretofore, there has not been known any tool that has been designed to facilitate the remounting of hung garments on a closet rod.

SUMMARY OF THE INVENTION

The structure of the present invention is designed to be used in combination with a conventional closet rod that is cylindrical and elongated and is fixedly mounted within a closet of the building structure with the longitudinal dimension of the closet rod being located adjacent to and parallel to a wall, but spaced from the wall. The closet rod is designed to support a plurality of garment hangers upon each of which is located a garment. In essence, each of the garments assumes a right angled position relative to the closet rod. The garment hanging tool of the present invention is designed to be mounted on the closet rod. The center area of the elongated body of the tool comprising a rod hanger section, engages the closet rod. The elongated body of the tool has a front section and a rear section each extending in opposite directions from the rod hanger section. The rear section terminates in an enlargement with this enlargement to rest against the wall thereby preventing pivoting movement of the garment hanging tool on the closet rod. This enlargement is to be located at an elevation lower than the rod hanger section so that when a garment hanger and its accompanying garment is placed on a hanger engagement formed on the front section of the body, the inherently created torque about the closet rod will press the enlargement into tight contact with the wall. The garment hanger and its supporting garment will now be located in a position spaced from the closet rod and oriented at a ninety degree relationship relative to the garments that are supported by garment hangers on the closet rod.

A primary objective of the present invention is to design a garment hanging tool which is to be used in conjunction with a conventional closet rod which facilitates the transition of the garments to and from the closet rod.

Another objective of the present invention is to construct a garment hanging tool which can be constructed relatively inexpensively and thereby sold to the ultimate consumer at a relatively inexpensive price.

DETAILED DESCRIPTION OF THE PREFERRED EMBODIMENT

Figure 2:
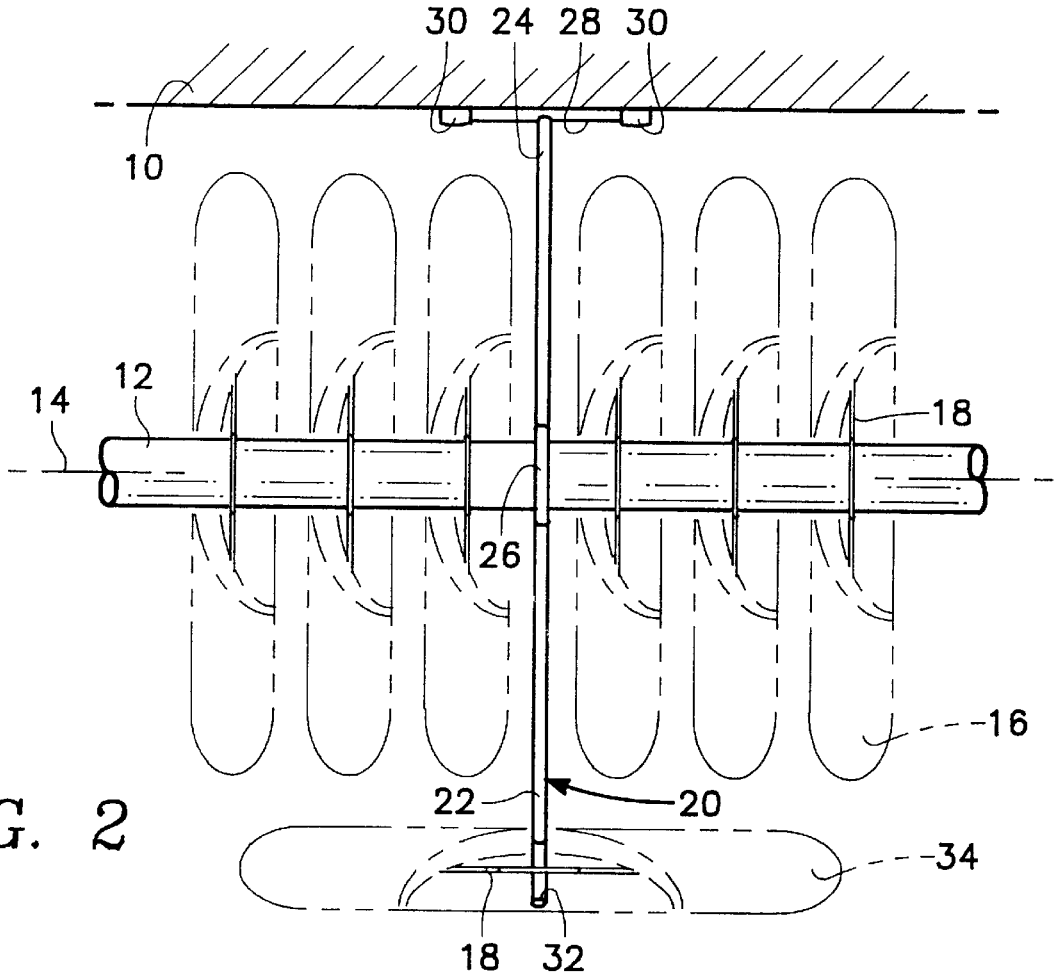
FIG. 2 is a top plan view of the garment hanging tool of the present invention taken along line 2—2 of FIG. 1.

Referring particularly to the drawings, there is shown a all 10 that is included within a building structure, which is not shown. A typical building structure would be a house or possibly even a commercial building. The wall 10 is generally oriented in a vertical manner fixedly mounted by some means, which is not shown. Within the building structure is a closet rod 12. The closet rod 12 is generally constructed of wood or plastic and would normally be in the range of an inch and a quarter to an inch and one-half inch in diameter. Closet rod 12 is entirely cylindrical and is mounted in a precise spaced arrangement from the wall 10. The longitudinal axis 14 of the closet rod 12 is to be located parallel to the surface of the wall 10. Typically, the mounting of the closet rod 12 is such that when a typical garment 16 is placed on a conventional garment hanger 18, the garment hanger 18 can be hangingly supported on the closet rod 12 so that the garment 16 will be located directly adjacent and perpendicular to the wall 10 but slightly spaced therefrom. Also, when the garments 16 are placed on the closet rod 12, it is to be noted that the garments 16 are located in a parallel relationship in respect to each other and generally are oriented in a transverse orientation relative to the closet rod 12. This transverse orientation is clearly shown in FIG. 2 of the drawing.

The garment hanging tool 20 has an elongated body which is formed into a front section 22 and a rear section 24 with the front section 22 and the rear section 24 being separated by a rod hanger section 26. Normally, the material of construction for the elongated body will be a metallic rod with it being understood that the metallic rod is integral from the front section 22 to the rod hanger section 26 and the rear section 24. The rod hanger section 26 is located substantially midway of the elongated body with the front section 22 being substantially the same length as the rear section 24. It is to be noted, in referring to FIG. 1, that the rear section 24 is oriented between a thirty and forty-five degree angle relative to the horizontal which causes the enlargement 28 mounted at the outer end of the rear section 24 being positioned at a lower elevation than the rod hanger section 26. Generally, the front section 22 is similarly inclined relative to the rod hanger section 26. Although not required, the inclination of the front section 22 is essentially identical to the inclination of the rear section 24. The rod hanger section 26 is basically U-shaped with the closet rod 12 to be located within the confines of the U and the rod hangar section 26 merely resting on the closet rod 12.

The enlargement 28 can take numerous forms with it generally being desired to comprise a transverse member usually constructed of bar stock which is essentially identical to the construction of the elongated body of the garment hanging tool 20. Typically, the length of the enlargement 28 will generally be about four to six inches. Typically, the bar stock that comprises enlargement 28 will generally be about one-quarter to three eights inch diameter metallic rod. The outer ends of the enlargement 28 are protected with plastic or rubber caps 30. It is the function of the caps 30 to prevent scarring or other types of damage to the wall 10.

Figure 1:
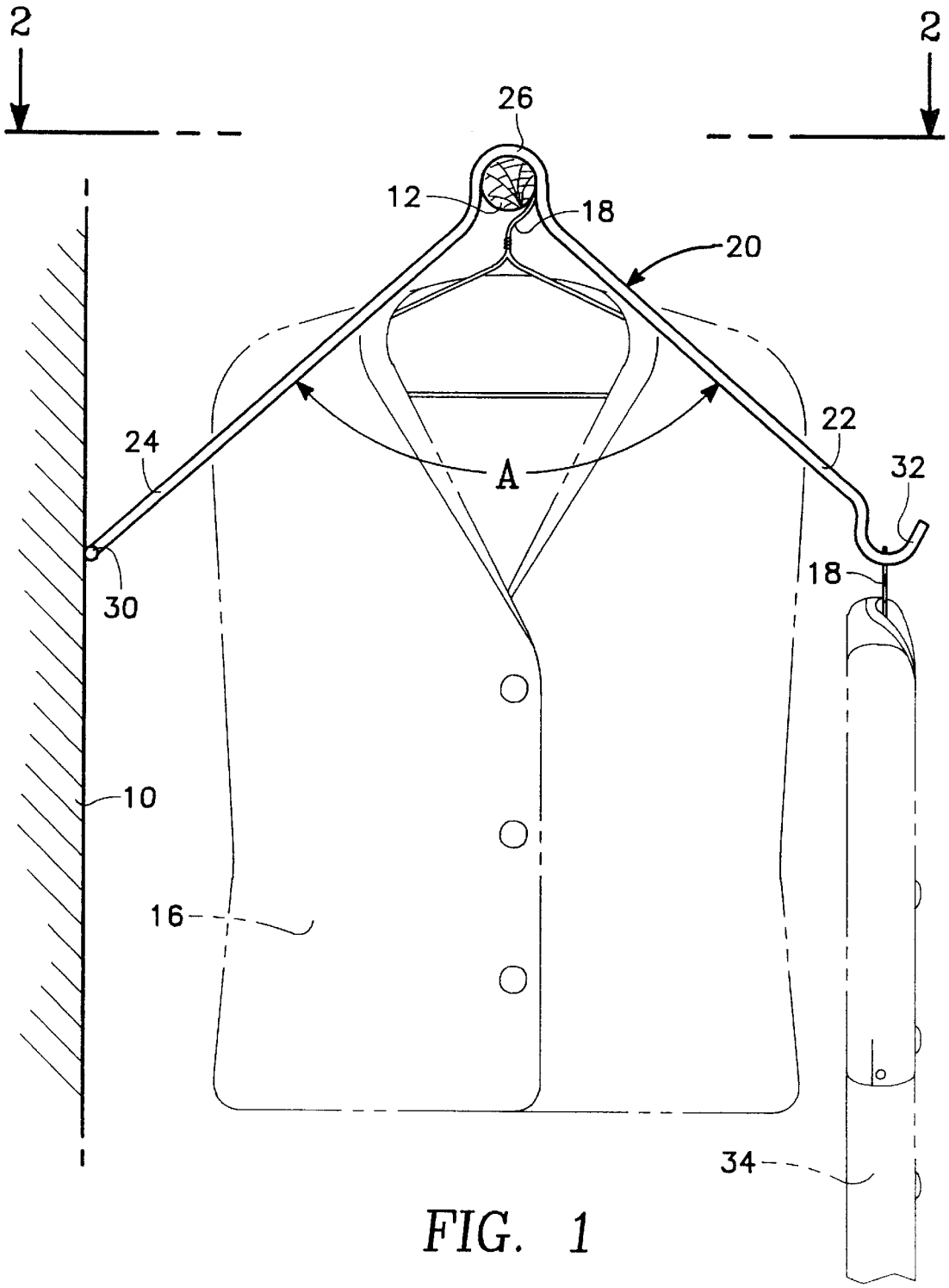
FIG. 1 is a transverse cross-sectional view through a typical closet rod showing the position of the garment hanging tool of the present invention in relation to the closet rod and a wall.

The outer end of the front section 22 terminates into a recess configuration which is defined as a hanger engagement 32. One or more garment hangers 18 and their supported garments 16 are to be placed in a hanging relationship on the hanger engagement 32. Inherently, because of the weight being applied at the outer end of the front section 22, there is a natural tendency to pivot the garment hanging tool 20 of this invention in a clockwise direction as is represented in FIG. 1. This will cause the enlargement 28 to be pressed tightly into contact with the wall 10. Therefore, the garment hanging tool 20 of this invention is located in a fixed relationship relative to the closet rod 12 and the wall 10.

It is to be understood that a single garment 34 could be suspended by the hanger engagement 32 or there could be suspended a plurality of such garments 34. The garment 34 is actually a garment 16 that has been removed from the closet rod 12.

Figure 3:
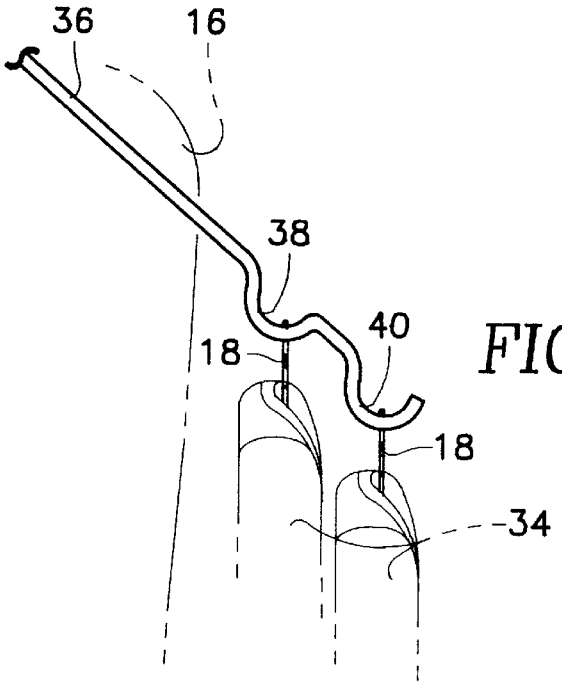
FIG. 3 is a side view of the front section of the garment hanging tool of the present invention showing a modification of the hanger engagement included within the front section.

Referring particularly to FIG. 3 of the drawings, there is shown a front section 36 which is essentially similar to front section 22 except that instead of a single hanger engagement 32, there is shown a pair of spaced apart hanger engagements 38 and 40. It is considered to be within the scope of this invention that there could be utilized a number greater than two in number of hanger engagements 38 and 40 if such is deemed to be desirable. Suspended by the hanger engagements 38 and 40 are garments 34 on garment hangers 18. It is to be noted that the hanger engagements 32, 38 and 40, in essence, comprise basically a hook configuration.

One of the desirable things about the present invention is that no tools are required to install the garment hanging tool 20 of this invention in its installed and operating position. Not only can a garment 16 be removed and placed in conjunction with the hanger engagement 32, but also garments in transition to the closet rod 12 can be placed in conjunction with the hanger engagement 32 prior to being removed therefrom and placed onto closet rod 12 at a particular location.

It is to be noted that the angular relationship between the front section 22 and the rear section 24 is depicted as angle A. Typically, this angle A will comprise an obtuse angle. It is not considered too likely within this invention to ever have angle A to comprise an acute angle but could comprise a right angle or an acute angle that is quite close to a right angle. For purpose of this invention, the definition of obtuse angle is to also include a right angle and an acute angle close to a right angle.

What is claimed is:

1. A garment hanging tool comprising:

an elongated body forming a front section and a rear section defining an obtuse angle therebetween, separating said front section and said rear section is a rod hanger section in the form of a U-configuration, said rod hanger section formed within said body adapted to connect with a closet rod by the closet rod being located within the confines of said U-configuration and said rod hanger section merely resting on the closet rod with said body oriented in a transverse relationship relative to the closet rod;

said rear section terminating in an enlargement in the form of a length of bar stock located transverse to said elongated body and parallel to the closet rod, said enlargement adapted to rest against a wall of a building structure within which is mounted the closet rod when said rod hanger section connects with the closet rod; and said front section having a hanger engagement in the form of a recess configuration, said hanger engagement adapted to connect with at least one garment hanger by a hook of the garment hanger resting in said recess configuration in order to position a garment on the garment hanger in a location spaced from the closet rod.

2. The garment hanging tool as defined in claim 1 wherein:

said enlargement being located at a lower elevation than said rod hanger section.

3. The garment hanging tool as defined in claim 2 wherein:

said hanger engagement being located at a lower elevation than said rod hanger section.

4. In combination with a closet rod, said closet rod extending in a longitudinal direction, said closet rod adapted to be mounted within a building structure, said closet rod being located adjacent to but spaced from a wall with said longitudinal direction being located substantially parallel to said wall when mounted within the building structure, a garment hanging tool comprising:

an elongated body forming a front section and a rear section defining an obtuse angle therebetween, separating said front section and said rear section is a rod hanger section in the form of a U-configuration formed within said body, said rod hanger section resting on said closet rod with said elongated body oriented in a transverse position relative to said closet rod;

said rear section terminating in an enlargement in the form of a length of bar stock located transverse to said elongated body and parallel to the closet rod, said enlargement adapted to rest against said wall; and said front section having a hanger engagement, said hanger engagement adapted to connect with at least one garment hanger to position a garment supported by the garment hanger in a position spaced from said closet rod.

5. The combination as defined in claim 4 wherein: said enlargement being located at a lower elevation than said rod hanger section.

6. The combination as defined in claim 4 wherein:

said hanger engagement being located at a lower elevation than said rod hanger section.

* * * * *